United States Patent [19]

Tharp

[11] Patent Number: 5,059,358

[45] Date of Patent: Oct. 22, 1991

[54] TUBULAR DIFFUSER WITH ADJUSTABLE PLUG

[75] Inventor: Charles E. Tharp, Columbia, Mo.

[73] Assignee: Environmental Dynamics, Inc., Columbia, Mo.

[21] Appl. No.: 532,863

[22] Filed: Jun. 4, 1990

[51] Int. Cl.[5] ..... B01F 3/04
[52] U.S. Cl. ..... 261/122
[58] Field of Search ..... 261/122

[56] References Cited

U.S. PATENT DOCUMENTS 4,640,803 2/1987 Schmidt-Kufeke et al. ..... 261/122
4,818,446 4/1989 Schreiber et al. ..... 261/122
4,960,546 10/1990 Tharp ..... 261/122

FOREIGN PATENT DOCUMENTS 3319161 11/1984 Fed. Rep. of Germany ..... 261/122

*Primary Examiner*—Tim Miles
*Attorney, Agent, or Firm*—Kokjer, Kircher, Bradley, Wharton, Bowman & Johnson

[57] ABSTRACT

A tubular membrane diffuser for a wastewater aeration system. The diffuser includes a pipe having spaced apart outlet ports and a porous membrane sleeved around the pipe for discharging air in bubbles. An adjustable plug can be located at the outboard end of the diffuser pipe in a fully buoyant application, near the inboard end of the diffuser pipe in a non-buoyant application where water occupies the outboard half of the diffuser, or anywhere between the diffuser pipe ends in a partially buoyant application. The plug includes a ring with a tapered bore and a tapered plug that threads into the bore to radially expand the ring for securing it in place.

3 Claims, 1 Drawing Sheet

TUBULAR DIFFUSER WITH ADJUSTABLE PLUG

BACKGROUND AND SUMMARY OF THE INVENTION

This invention relates generally to the aeration of waste water and more particularly to a tubular membrane diffuser equipped with an adjustable plug that permits both buoyant and non-buoyant service of the diffuser.

In the treatment of wastewater, it is common practice to provide an aeration system that includes a plurality of pipes installed in a treatment basin containing the wastewater. The piping for larger basins includes parallel air laterals that are supplied with air and in turn supply diffusers which discharge the air to the wastewater near the bottom of the basin. Different types and configurations of diffusers are used, and the different types of diffusers can discharge the air in the form of fine bubbles, medium size bubbles or coarse bubbles. The type and configuration of diffuser that is used depends upon a number of variables, including the necessary efficiency and the maintenance requirements.

The present invention is directed to an improved tubular membrane diffuser for use in a wastewater treatment system. The diffuser is characterized by a plastic pipe on which a porous membrane is sleeved in order to discharge air bubbles to the wastewater. It is a particular feature of the invention that the diffuser is equipped with an adjustable plug which can be positioned virtually anywhere along the length of the diffuser pipe between a fully buoyant position and a substantially non-buoyant position. When the diffuser is to serve in a buoyant application, the plug can be positioned at the outboard end of the diffuser pipe, and the entire length of the pipe is then filled with air. In a non-buoyant application, the plug is positioned near the inboard end of the diffuser so that most of the pipe is filled with water to counteract the buoyancy force of the air supplied to the diffuser. The plug can also be adjusted to any position along the length of the diffuser pipe for service in a partially buoyant application.

The plug is a two-piece unit which includes a ring with a tapered bore and a tapered plug element that threads into the bore. As the plug element is progressively threaded into the ring, the wedging action resulting from the mating tapers causes the ring to radially expand so that it is held tightly against the inside wall of the pipe at the desired location. The ring and plug element then seal effectively against the passage of air beyond the plug assembly.

It is an important feature of the invention that the plug is removable. This allows the plug to be adjusted in its position along the diffuser to vary the buoyancy, and it also permits the plug to be removed so that accumulated solids and other blockages can be flushed out of the end of the diffuser.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
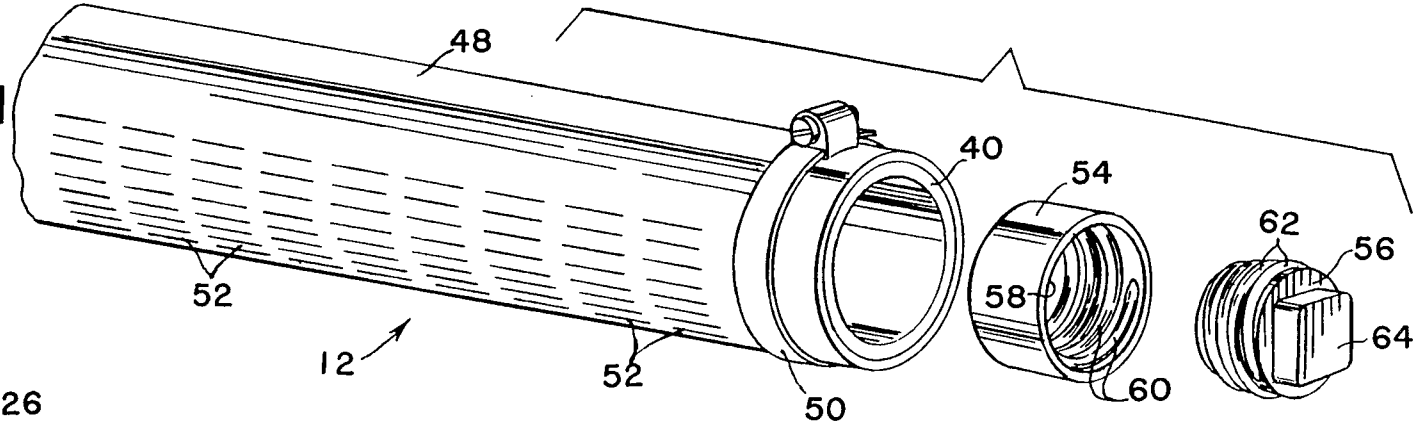
FIG. 1 is an exploded perspective view of the outboard end portion of a tubular membrane diffuser equipped with an adjustable plug assembly in accordance with a preferred embodiment of the present invention.

Referring now to the drawings in more detail, the present invention is directed to a tubular membrane diffuser which may be used in a wastewater aeration system of the type disclosed in pending application Ser. No. 340,265, now U.S. Pat. No. 4,960,546, filed on Apr. 19, 1989, in the name of Charles E. Tharp, to which reference may be made for a more thorough understanding of the structure and configuration of the aeration system. As described in the reference application, air under pressure is supplied through suitable piping to air laterals such as the lateral 10 (See FIG. 2). The air lateral 10 extends horizontally generally along the bottom of the wastewater treatment basin and may be anchored to the bottom at spaced apart locations.

In accordance with the present invention, the air lateral 10 supplies a diffuser assembly which may include two axially aligned diffusers 12 (See FIG. 2) which are identical to one another and arranged in a duplex installation. The diffuser assembly is mounted to the air lateral 10 by a saddle assembly which is generally identified by numeral 14 and which is preferably of the type disclosed in detail in the previously referenced co-pending application Ser. No. 340,265. The saddle 14 includes upper and lower saddle sections 16 and 18 which are hinged together by means of a C-shaped flange 20 on the upper saddle section 16 which receives a lip 22 projecting from the lower section 18. Opposite the flange 20 and lip 22, the saddle sections 16 and 18 are provided with hooks 24 which are secured together by a special fastener 26 having a tapered passage which receives and locks the hooks 24 together. When the fastener 26 is tightened, the saddle 14 is secured in place on the air lateral 10.

Extending from the lower saddle section 18 is an outlet spout 28 which aligns with a drilled port 30 in the air lateral 10. A seal (not shown) provides an air tight seal around the port 30. The spout 28 is internally threaded and receives a pipe nipple 32 which is threaded on its upper end to mate with the internal threads of the spout 28. At its lower end, the pipe nipple 32 is received in and solvent welded to the inlet 34 of a plastic Tee fitting 36. The Tee fitting 36 has two axially aligned outlets 38 which extend in opposite directions and to which the respective diffusers 12 are mounted.

Each diffuser 12 includes a hollow plastic pipe 40 which may be a two-inch diameter pipe approximately two feet long. Each pipe 40 has a inboard end 42 which is received in and solvent welded to the corresponding outlet 38 of the Tee fitting 36. Numeral 44 identifies the opposite or outboard end of the pipe 40.

Figure 2:
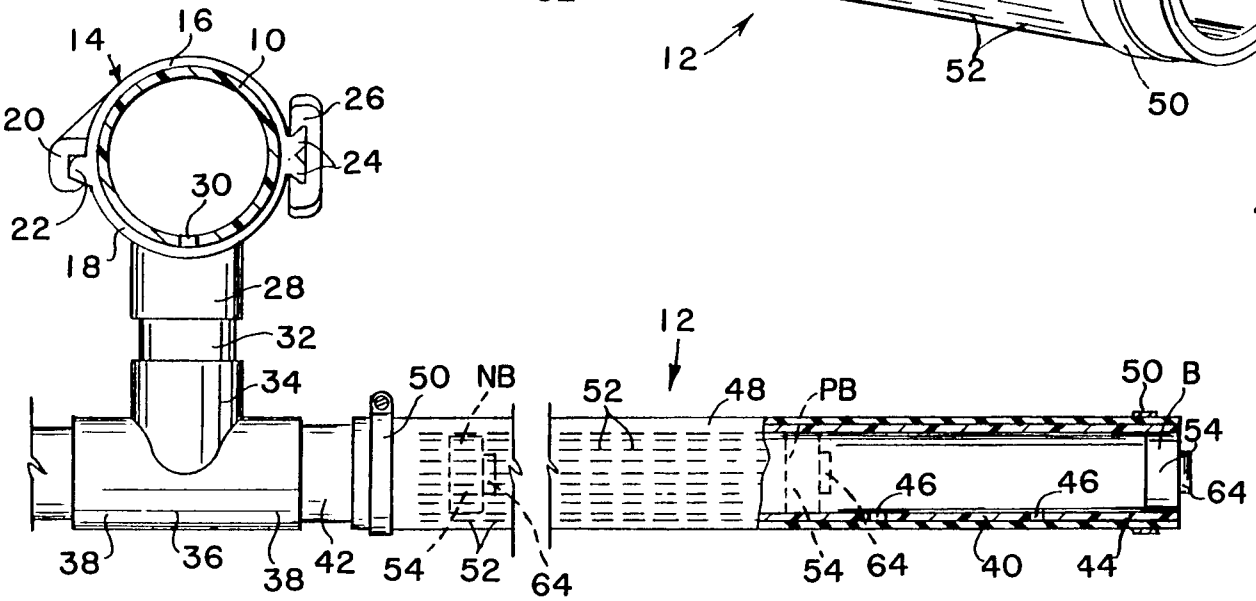
FIG. 2 is a fragmentary elevational view showing a duplex diffuser assembly mounted on an air lateral that supplies air to the diffusers, with a portion of the diffuser shown in section for purposes of illustration and the broken line positions of the plug indicating a partially buoyant and a non-buoyant location.

As best shown in FIG. 2, each diffuser pipe 42 is provided with a plurality of ports 46 which extend through the pipe wall at spaced locations along the length of the pipe. Preferably, the ports 46 are located in the bottom of the diffuser pipe. A cylindrical membrane 48 is sleeved closely around each diffuser pipe 40 and extends around the pipe along substantially its entire length. The membrane may be constructed of EPDM or another suitable material. Hose clamps 50 are tightened on the membrane 48 to secure it in place on the diffuser pipe. Each membrane 48 presents pores 52 through which the air passes through the membrane into the wastewater that is undergoing treatment. In this manner, the diffuser applies air bubbles to the wastewater.

Figure 3:
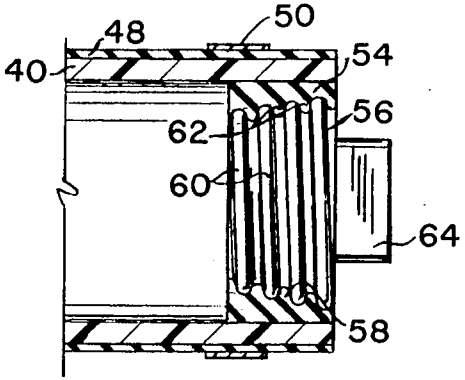
FIG. 3 is a fragmentary sectional view on an enlarged scale showing the plug assembly secured in place at the outboard end of one of the diffusers at a buoyant location.

In accordance with the present invention, each diffuser pipe 40 receives a plug assembly which is a two-piece unit including a ring 54 and a plug element 56. The ring 54 is preferably constructed of a relevantly soft material such as thermoplastic rubber or polyurethane elastomer which is able to effectively seal against the inside wall of the diffuser pipe 40. The outside diameter of the ring 54 is slightly less than the inside diameter of the diffuser pipe 40. As best shown in FIG. 3, the ring 54 is provided with a bore 58 which tapers from end to end and which is provided with internal threads 60.

The plug element 56 likewise tapers from end to end and is provided with exterior threads 62 that mate with the threads 60. The plug element 56 may be constructed of reinforced polypropylene or another relatively hard plastic. The size and shape of the plug element 56 are such that it is able to fit closely in the bore 58 with the threads 60 and 62 mating. Because of the tapers of the bore 58 and the plug 56, progressive threading of the plug element into the ring 54 causes a progressively tighter fit of the plug in the bore. Consequently, the deformable ring is caused to expand radially outwardly by the wedging action provided by the tapered plug element. Conversely, when the plug element is threaded out of the bore 58, the wedging effect is relaxed and the ring 54 is able to retract radially to its normal undeformed condition. The outer surface of the plug 56 is provided with a square head 64 which facilitates gripping of the plug with a wrench or other tool that may be used to thread or unthread the plug.

In operation, air under pressure is supplied to the aeration system and to the lateral pipe 10. From the lateral pipe, the air flows through the outlet port 30 and through spout 28 and the pipe nipple 32 into the Tee fitting 36. The air in the Tee fitting flows in substantially equal amounts in opposite directions into the two diffusers 12 and out of the diffusers through the ports 46. The air is able to pass through the pores 52 so that it is discharged into the wastewater into the form of small bubbles which rise to the surface.

It is a particular feature of the invention that the adjustable plug assembly permits the diffusers 12 to be used in fully buoyant service, substantially non-buoyant service, or partially buoyant service. When the diffusers are to be used in a buoyant application, the ring is located at the outboard end 44 of each diffuser pipe 40 as shown in FIG. 3 and in the solid line position identified at "B" in FIG. 2. With the ring located adjacent to the outboard end 44, the plug element 56 is threaded securely into the bore 58 in order to expand ring 54 and thereby secure it against the inside surface of the diffuser pipe 40 by wedging action. At the same time, the ring 54 and plug element 56 cooperate to provide an airtight seal which prevents air from leaking out the outboard end of the diffuser pipe in any appreciable quantity. It is noted that in a buoyant application where the plug assembly is located at the outboard end 44 of the diffuser pipe, the entire length of the diffuser pipe is supplied with air.

Alternatively, the diffusers 12 can serve in a partially buoyant application. Then, the adjustable plug assembly can be moved inboard to any desired location. For example, the plug can be positioned near the midpoint of the length of the diffuser pipe 40, as indicated by broken line position identified as "PB" in FIG. 2. The plug can be moved to this position by unthreading the plug element 56 from the ring 54 and, with the plug assembly in a loose condition, pushing the ring and plug element inwardly into the pipe to the desired location. A long-handled tool can be applied to the head 64 and used to thread the plug element 56 into the ring 54, thus expanding it and securing it in place by the wedging action that results from the mating tapers of the bore and plug.

In partially buoyant service, only the part of the diffuser pipe 40 inboard of the plug assembly is filled with air because air cannot pass the plug assembly and reach the outboard half of the diffuser pipe. Because the outboard end 44 is then open, water from the treatment basin enters the outboard half of the pipe and occupies the part of the pipe located outboard of the plug assembly. The weight of the water that is contained inside of the diffuser pipe 40 counters the buoyant force of the air which occupies the inboard half of the diffuser pipe, and it is also noted that the buoyant force is reduced because of the reduced length of the diffuser pipe that is available to air compared to the situation in the buoyant location of the plug assembly.

The plug assembly can be positioned at virtually any location inboard of the buoyant position B, and the buoyancy is progressively decreased as the plug is moved inboard along the diffuser. When the plug is situated at the location identified as "NB", in FIG. 2, it is only about three or four inches from the clamp board 50, and this is a substantively non-buoyant position because only a small part of the pipe 40 receives air and nearly the entire pipe is filled with water.

It is pointed out that the ports 46 should be located only inwardly from the plug assembly to prevent air from flowing back into the pipe and out through its end rather than through the membrane 48 as intended. Regardless of the location of the plug, the air that enters pipe 40 exits the pipe through the ports 46 and flows into the entire space between the outer surface of the pipe and the membrane 48 (between the clamp bands 50), so the air is discharged through the entirety of the membrane in buoyant service, non-buoyant service, and partially buoyance service.

It is thus apparent that the adjustability of the plug readily accommodates any desired degree of buoyancy, depending upon the balance that is desired in each particular application. Non-buoyant and low buoyant systems are advantageous in many respects. For example, the stress exerted on the cantilever diffuser pipe is reduced as the buoyancy decreases, and this permits the use of longer diffusers with better coverage of the basin floor. Reduced buoyancy also reduces the vibrational forces on the diffuser to improve the pumpage of liquid past the diffuser and reduce the coalescence of bubbles which in turn enhances the oxygen transfer efficiency of the system. Reduced buoyancy has the additional advantage of reducing the forces on the pipe anchors which hold the pipes down near the bottom of the basin. Finally, reduced buoyancy reduces the diffuser deflection and results in more uniform discharge of air along the diffuser length. If the diffuser deflects such that its free end is above its inboard end, the free end portion receives a disproportionate amount of air and the uniformity of the air discharge suffers accordingly. This effect is more pronounced with longer diffusers.

In this manner, the diffusers 12 are able to operate effectively and efficiently to aerate the wastewater in the treatment basin. The adjustability of the position of the plug assembly allows it to be used in the non-buoyant location, any partially buoyant location, or the buoyant location, depending upon the particular application of the diffuser. When a duplex diffuser assembly of the type shown in FIG. 2 is used, the two diffusers 12 are axially aligned with their common longitudinal axis occupying a horizontal plane so that the diffusers are level and receive equal amounts of air. However, it should be noted that the diffuser of the present invention can be used in different types of diffuser assemblies as well as the duplex arrangement shown in FIG. 2.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A diffuser for aerating wastewater, comprising:

a hollow pipe having first and second ends, said first end serving as an inlet end for receiving incoming air from an air source;

port means in said pipe for discharging air therefrom at a location between said first and second ends;

a flexible membrane sleeved onto said pipe and presenting pores through which air from the pipe is discharged through the membrane into the wastewater in the form of air bubbles;

a deformable ring fitted in the pipe and being movable therein along the length of the pipe, said ring having a threaded bore which tapers from end to end; and a tapered plug element threaded to mate with the threads of said bore and acting to expand said ring against the pipe by wedging action as the plug element is progressively threaded into said bore, thereby permitting said ring to be secured in said pipe at said second end for fully buoyant service of the diffuser, at another location adjacent to said first end for substantially non-buoyant service of the diffuser, and at a plurality of locations between said first and second ends for partially buoyant service of the diffuser, said ring and plug element acting to seal the pipe against air passage beyond the ring and plug element.

2. A field adjustable diffuser assembly for a wastewater aeration system having an air lateral supplied with air under pressure and an outlet conduit for receiving air from the air lateral, said diffuser assembly comprising:

a Tee fitting connected with said outlet conduit to receive air therefrom and having a pair of axially aligned outlets;

a pair of pipes each having opposite inboard and outboard ends, said pipes being connected at the inboard ends thereof with the respective outlets of said Tee fitting to extend therefrom in opposite directions with the pipe axis oriented substantially horizontally;

port means in each pipe for discharging air therefrom at a location between the ends of the pipe;

a flexible membrane for each pipe sleeved closely thereon and presenting pores through which air from the pipe passes into the wastewater for aeration thereof;

a field adjustable plug assembly for each pipe having a size to fit closely in the pipe and being adjustable along the length thereof, each plug assembly including a deformable ring movable in the pipe along the length thereof and having a threaded bore which tapers from end to end; and a tapered plug element in each plug assembly threaded to mate with the threads of said bore and acting to expand the ring against the pipe by wedging action as the plug element is progressively threaded into the bore, thereby securing said plug assemblies in the respective pipes at the outboard ends thereof for fully buoyant service wherein air can occupy substantially the entire length of each pipe, and at a plurality of other locations in each pipe inboard from the outboard end of the pipe for non-buoyant and partially buoyant service wherein water occupies the portion of each pipe outboard from the plug assembly.

3. In a wastewater aeration system having a submerged air lateral receiving air under pressure and a plurality of diffusers each connected with the air lateral to receive air therefrom, an improved diffuser construction comprising:

a hollow pipe having inboard and outboard ends and port means between said ends for discharging air from the pipe;

a porous membrane sleeved closely on the pipe for discharging the air into the water in bubbles;

a deformable ring having a size to be fitted closely in the pipe and being adjustable along the length thereof between a fully buoyant position adjacent said outboard end and a substantially non-buoyant position adjacent said inboard end, said ring having a threaded bore which tapers; and a tapered plug threaded to mate with the threads of said bore and to expand said ring by wedging action upon progressive threading of the plug into said bore to thereby secure the ring and plug in the pipe at the fully buoyant position, the non-buoyant position, or any position therebetween in a manner to seal the pipe against air flow past the ring and plug.

* * * * *